US010780302B2

(12) United States Patent
West

(10) Patent No.: US 10,780,302 B2
(45) Date of Patent: Sep. 22, 2020

(54) FIRE CONTAINMENT SYSTEM AND METHODS OF USE THEREOF

(71) Applicant: Brandon West, Roswell, GA (US)

(72) Inventor: Brandon West, Roswell, GA (US)

( * ) Notice: Subject to any disclaimer, the term of this patent is extended or adjusted under 35 U.S.C. 154(b) by 182 days.

(21) Appl. No.: 15/928,061

(22) Filed: Mar. 21, 2018

(65) Prior Publication Data

US 2019/0060684 A1 Feb. 28, 2019

Related U.S. Application Data

(60) Provisional application No. 62/549,916, filed on Aug. 24, 2017.

(51) Int. Cl.
*A62C 2/10* (2006.01)
*A62C 3/02* (2006.01)

(52) U.S. Cl.
CPC ..... *A62C 2/10* (2013.01); *A62C 3/0257* (2013.01)

(58) Field of Classification Search
CPC .... A62C 2/06; A62C 2/10; A62C 2/24; A62C 2/241; A62C 3/0257
USPC ..... 169/48
See application file for complete search history.

(56) References Cited

U.S. PATENT DOCUMENTS

| | | | | |
|---|---|---|---|---|
| X951681 | | 3/1910 | Dunlevy | |
| 3,635,290 | A | 1/1972 | Schneider | |
| 4,311,199 | A | 1/1982 | Elias | |
| 5,642,767 | A * | 7/1997 | Nair | A62C 2/18 160/189 |
| 7,686,094 | B2 | 3/2010 | Kleff | |
| 8,146,298 | B2 | 4/2012 | Bush et al. | |
| 8,297,371 | B1 | 10/2012 | Musser, Jr. | |
| 8,814,470 | B2 | 8/2014 | Belzile et al. | |
| 8,844,640 | B2 | 9/2014 | Linares | |
| 8,997,884 | B1 | 4/2015 | Morlier | |
| 9,750,962 | B2 | 9/2017 | Margolin | |
| 2005/0161235 | A1 | 7/2005 | Chuprin | |
| 2006/0225244 | A1 * | 10/2006 | Melinette | A47H 15/04 16/93 R |
| 2009/0194297 | A1 * | 8/2009 | Ortiz Teruel | A62C 2/10 169/50 |
| 2009/0229840 | A1 | 9/2009 | Fernandez | |
| 2010/0269449 | A1 * | 10/2010 | Bush | A62C 2/06 52/741.3 |
| 2010/0294520 | A1 * | 11/2010 | Aguirre | A62C 3/0257 169/45 |
| 2010/0300707 | A1 | 12/2010 | Kolios | |
| 2011/0067891 | A1 * | 3/2011 | Linares | A62C 2/10 169/48 |
| 2014/0209330 | A1 | 7/2014 | Statter et al. | |

(Continued)

*Primary Examiner* — Cody J Lieuwen
(74) *Attorney, Agent, or Firm* — Mathew L. Grell; Jeffrey C. Watson; Grell & Watson Patent Attorneys LLC

(57) ABSTRACT

A fire containment system strung across the ground and methods of use thereof, that generally includes two or more vertical towers anchored in series in the ground, a lift system integral to each of said two or more vertical towers having a plurality of vertically slidable swivel joints capable of vertical travel there up one of the two or more vertical towers, one or more cables, each cable strung between one of the plurality of vertically slidable swivel joints on each of the two of the or more vertical towers, a fire proof curtain affixed to said one or more cables, a below ground storage to contain said fire proof curtain.

16 Claims, 6 Drawing Sheets

(56) References Cited

U.S. PATENT DOCUMENTS

2015/0306435 A1* 10/2015 Margolin ..... A62C 2/10
169/45
2016/0037953 A1* 2/2016 Price ..... A47H 15/02
160/341

* cited by examiner

FIRE CONTAINMENT SYSTEM AND METHODS OF USE THEREOF

CROSS-REFERENCE TO RELATED APPLICATIONS

To the full extent permitted by law, the present United States Non-provisional Patent Application hereby claims priority to and the full benefit of United States Provisional Application entitled "FIRE CONTAINMENT SYSTEM AND METHODS OF USE THEREOF," having assigned Ser. No. 62/549,916, filed on Aug. 24, 2017, incorporated herein by reference in its entirety.

FEDERALLY SPONSORED RESEARCH OR DEVELOPMENT

None

PARTIES TO A JOINT RESEARCH AGREEMENT

None

REFERENCE TO A SEQUENCE LISTING

None

TECHNICAL FIELD

This disclosure relates to a fire containment system and methods of use thereof. More specifically the disclosure relates to a wild fire protection shield formed of a series of towers to support a fire barrier.

BACKGROUND

Every year billions of dollars' worth of timber land, recreational facilities, homes, businesses, buildings, industrial plants or other structures, forests, pastures or parks and other large acreage natural resources are lost due to brush fires and wildfires. Many of these fires take several days or even weeks to contain. Realizing that one way to stop the loss is to prevent the fires from occurring, great efforts are made and much time is spent in educating the public so that the fires will not occur. However, no matter how much care is taken, there is no way to stop forest fires from occurring since some fires may be started by natural causes, such as lightning, storms, firestorms, earthquakes, hurricanes, tornadoes, natural causes, human negligence or arson.

When a fire breaks out in one of our forests or brush areas, such as the yearly fire disasters in the United States, specifically in the California region, crews are sent in to try and contain it, by digging, grading, and clearing of areas of trees and other wooded brush in advance of a progressing fire, such as in order to create a fire break to prevent the fire from spreading. Fire retardant sprays and powders, such as dropping of chemical retardants from planes or helicopters are also used but these generally are not effective in stopping the travel of the fire, especially during windy conditions.

In California alone, wildfires in 2017 amounted to 9,133 total fires, burning a total area of 1,381,405 acres (5,590.35 km2), with lost homes, structures, plants, wildlife estimated at $13.028 billion (2017 USD), with fatalities of 1 firefighter and 45 civilians, and non-fatal injuries 12 firefighters and 199 civilians.

One previous approach to wild fire containment is to utilize a plurality of sails, which are adapted to be erected in the path of the fire. The lower ends of the sails are secured to the ground via stakes and the upper ends of the sails are elevated using hot air balloons. One disadvantage of this approach is the personnel time and risk due to the sails having to be transported to a fire line, staked in place in the path of the fire, and then elevated with hot air balloons during an advancing wild fire.

Another approach to wild fire containment is to cover the high priced structure, such as facilities, homes, businesses, buildings, industrial plants or other structures, with a fire-resistant insulation layer able to withstand temperatures up to about 2000° C. and a deployable and erectable frame. One disadvantage of this approach is the fire containment is only protecting the structure and not the surrounding forests, pastures or parks and other large acreage natural resources or animals and insects that cohabitate the area. Moreover, this approach is useful only if adequate time to deploy and exit the area remains.

Still another approach to wild fire containment is an upwardly extensible firewall curtain based on an articulating pairs of arms or telescoping/pivoting elongate cylinders used to upwardly extend. One disadvantage of this approach is the complicated mechanical vertical risers require testing and maintenance and backup power to deploy in a blackout situation and such mechanical devices may not deploy leaving a break in the fire wall.

Therefore, it is readily apparent that there is a need for a fire containment system and methods of use thereof that functions to enable a combination of features including to provide a permanent wild fire protection shield positioned in known recurring fire paths ready to be deployed, protecting not only the structure but the surrounding area, and without the need for complicated mechanical vertical risers which may not deploy leaving a break in the fire wall.

BRIEF SUMMARY

Briefly described, in an example embodiment, the present disclosure overcomes the above-mentioned disadvantages and meets the recognized need for a fire containment system strung across the ground and methods of use thereof, that generally includes two or more vertical towers anchored in series in the ground, a lift system integral to each of said two or more vertical towers having a plurality of vertically slidable swivel joints capable of vertical travel there up one of the two or more vertical towers, one or more cables, each cable strung between one of the plurality of vertically slidable swivel joints on each of the two of the or more vertical towers, a fire proof curtain affixed to said one or more cables, a below ground storage to contain said fire proof curtain.

According to its major aspects and broadly stated, the present disclosure in its exemplary form is fire containment system strung across the ground and methods of use thereof, that generally includes two or more vertical towers anchored in series in the ground, a lift system integral to each of said two or more vertical towers having a plurality of vertically slidable swivel joints capable of vertical travel there up one of the two or more vertical towers, one or more cables, each cable strung between one of the plurality of vertically slidable swivel joints on each of the two of the or more vertical towers, a fire proof curtain affixed to said one or more cables, a below ground storage to contain said fire proof curtain, and thus to provide a permanent wild fire protection shield positioned in known recurring fire paths ready to be deployed, protecting not only the structure but the surrounding area, and without the need for complicated mechanical vertical risers which may not deploy leaving a break in the fire wall.

In an exemplary embodiment, the fire containment system to provide a fire wall barrier to a fire proceeding across the ground, including two or more vertical towers anchored in series in the ground, a lift system integral to each of the two or more vertical towers, the lift system having a plurality of vertically slidable cable lift attachment devices, one or more support cables strung between the two or more vertical towers, the one or more support cables having a first cable end and a second cable end, the first cable end affixed to one of the plurality of vertically slidable cable lift attachment devices in a first tower of the two or more vertical towers and the second cable end affixed to one of the plurality of vertically slidable cable lift attachment device in a second tower of the two or more vertical towers, and a fire proof curtain affixed to the one or more cables.

A feature of the fire containment system and methods of use is the ability to provide a gravity powered lift system integral to each of the two or more vertical towers to raise the plurality of vertically slidable swivel joints.

Another feature of the fire containment system and methods of use is the ability to provide a track for the plurality of vertically slidable swivel joints vertically positioned thereon or therein the two or more vertical towers.

Yet another feature of the fire containment system and methods of use is the ability to provide a weight with a potential energy elevated to the top of the two or more vertical towers and cabled pulleys to provide an unpowered vertical lifting force to raise the plurality of vertically slidable swivel joints.

Yet another feature of the fire containment system and methods of use is the ability to provide a powered elevation system to provide vertical lifting force to raise the plurality of vertically slidable swivel joints.

Yet another feature of the fire containment system and methods of use is the ability to provide a solar powered elevation system to provide vertical lifting force to raise the plurality of vertically slidable swivel joints.

Yet another feature of the fire containment system and methods of use is the ability to provide an uninterruptable power supply system to provide vertical lifting force to raise the plurality of vertically slidable swivel joints.

Yet another feature of the fire containment system and methods of use is the ability to provide a drive motor to provide vertical lifting force to raise the plurality of vertically slidable swivel joints.

Yet another feature of the fire containment system and methods of use is the ability to provide a drive motor and a screw or threaded lift or cabled pulleys to provide vertical lifting force to raise the plurality of vertically slidable swivel joints.

Yet another feature of the fire containment system and methods of use is the ability to provide a two dimensional vertically slidable swivel joints to reduce snags and tension between opposing vertically slidable swivel joints on opposing two or more vertical towers as vertically slidable swivel joints are being raised.

Yet another feature of the fire containment system and methods of use is the ability to provide a fire proof Kevlar (or any other fire proof type material) or stranded high strength cable or rope as one or more cables Yet another feature of the fire containment system and methods of use is the ability to provide one of the two or more vertical towers as a cell tower.

Yet another feature of the fire containment system and methods of use is the ability to provide a fire proof curtain affixed to the one or more cables composed of a material such as, aluminum or asbestos to resist direct flame and contain any flying embers attempting to pass through.

Yet another feature of the fire containment system and methods of use is the ability to provide a fire proof curtain having micro-holes to accommodate windy areas.

Yet another feature of the fire containment system and methods of use is the ability to provide a fire proof curtain affixed to the one or more cables composed of fire-resistant material comprised essentially of the fire-resistant insulation having a thermo-insulating capacities and thermo-insulating gradient wherein on the exterior side of the insulation, the insulation withstands temperatures of at least 1200° C. and up to 2000° C.

Yet another feature of the fire containment system and methods of use is the ability to position therein or thereon at least one of the two or more vertical towers fire suppression equipment, such as fire suppression nozzles, pumps, and fire sensing lines or other apparatus to sense and extinguish a fire.

Yet another feature of the fire containment system and methods of use is the ability to position therein or thereon at least one of the two or more vertical towers or thereby fire suppression equipment, such as water or foam based or may use other fire suppressing fluids or substances.

Yet another feature of the fire containment system and methods of use is the ability to position therein or thereon at least one of the two or more vertical towers or thereby fire suppression equipment, contain foam or other extinguishing agent.

Yet another feature of the fire containment system and methods of use is the ability to position the two or more vertical towers in series, staggered series, overlapping series, and two or more rows in series, part of a network or series of spaced towers (depending on the layout of the land and fire length and height hazard).

Yet another feature of the fire containment system and methods of use is the ability to size the two or more vertical towers at necessary height to elevate the a fire proof curtain to contain above burnable material, possible flame or spark heights, such as between 100 to 400 feet high or other heights.

Yet another feature of the fire containment system and methods of use is the ability to construct the two or more vertical towers depending on the layout of the land and fire length and height hazard, the towers may be permanent or temporary structures mounted for example on concrete bases.

Yet another feature of the fire containment system and methods of use is the ability to be utilized in fire prone areas to contain the spread of wildfires, or to establish fire protection zones near fire prone areas, such as timber land, recreational facilities, homes, businesses, buildings, industrial plants or other structures, forests, pastures or parks and other large acreage natural resources, infrastructure, school, hospitals, power, communications, and the like.

Yet another feature of the fire containment system and methods of use is the ability to provide a curtain storage container proximate the ground cover to store the fire proof curtain in a waterproof box or container.

Yet another feature of the fire containment system and methods of use is the ability to provide communication systems to remotely monitor, activate, or deploy the fire containment system.

Yet another feature of the fire containment system and methods of use is the ability to provide a fire wall barrier to a fire proceeding across the ground.

These and other features of the fire containment system and methods of use will become more apparent to one skilled in the art from the prior Summary and following Brief Description of the Drawings, Detailed Description of exemplary embodiments thereof, and Claims when read in light of the accompanying Drawings or Figures.

BRIEF DESCRIPTION OF THE DRAWINGS

The present fire containment system and methods of use will be better understood by reading the Detailed Description of the Preferred and Selected Alternate Embodiments with reference to the accompanying drawing Figures, in which like reference numerals denote similar structure and refer to like elements throughout, and in which.

DETAILED DESCRIPTION

In describing the exemplary embodiments of the present disclosure, as illustrated in FIGS. 1A, 1B, 2A, 2B, 3A, 3B, 3C, 4A, 4B, 4C, 5, and 6 specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Figure 1A:
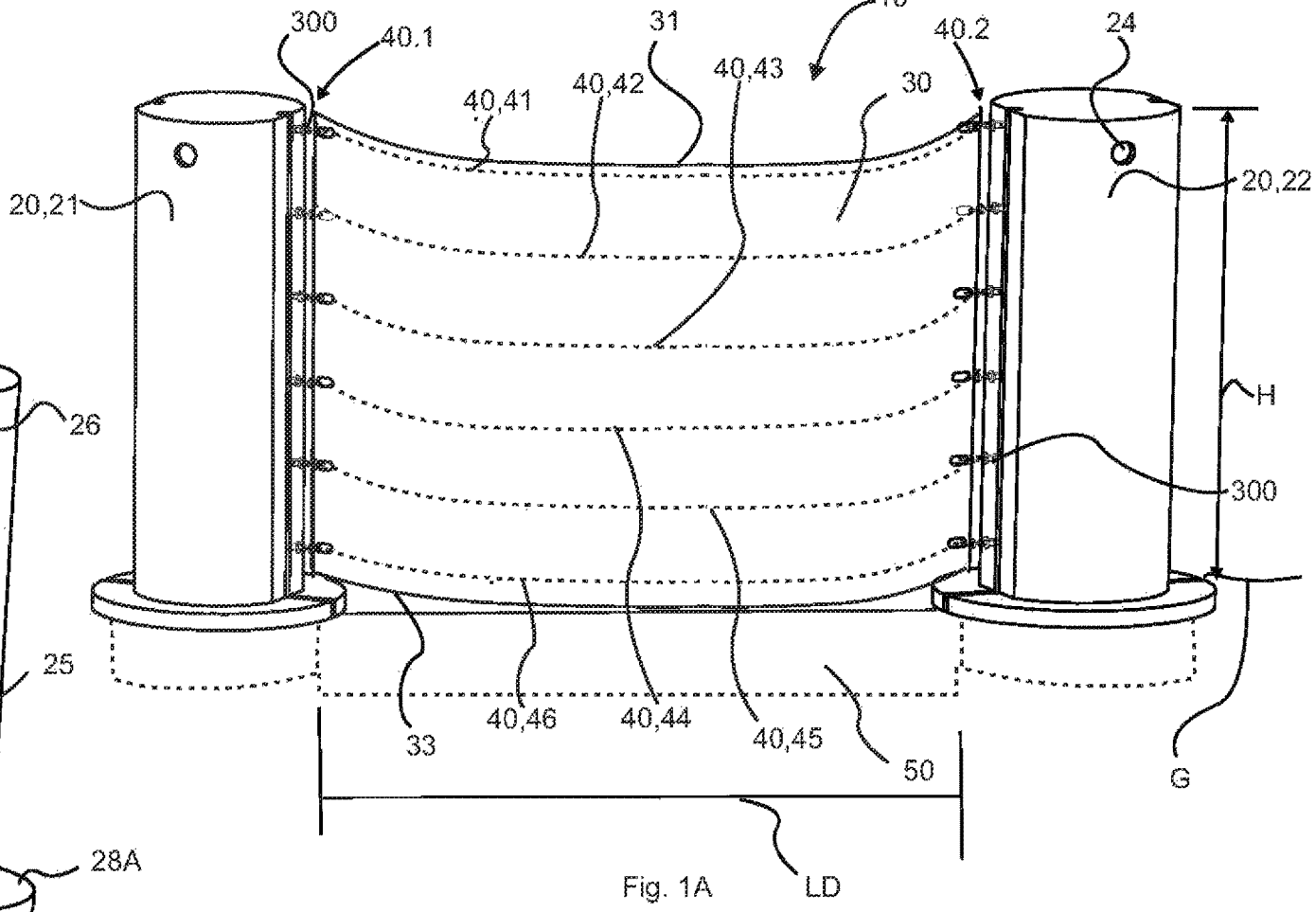
FIG. 1A is a front perspective view of an exemplary embodiment of the fire containment system.
Figure 1B:
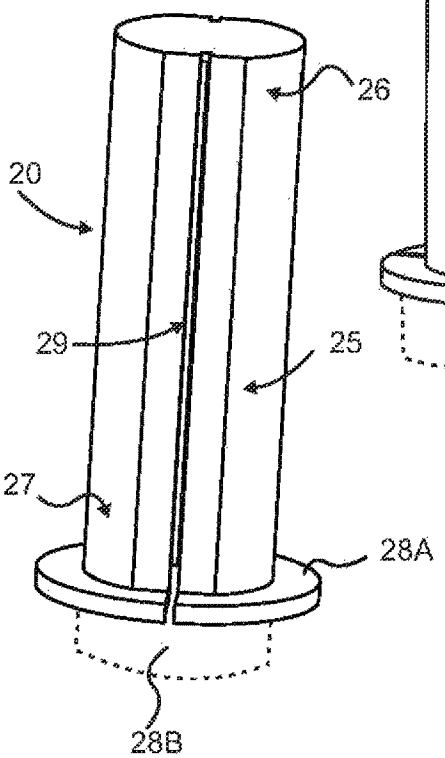
FIG. 1B is a side view of an exemplary embodiment of the tower or vertical riser, shown in FIG. 1.

Referring now to FIGS. 1A and 1B, by way of example, and not limitation, there is illustrated an example embodiment fire containment system 10. Fire containment system 10 may be configured having two or more vertical support risers, such as tower 20, planar fire proof or fire resistant screen, such as fire proof curtain 30 positioned between two tower 20, and a towline or rope, such as one or more support cables 40 (shown support cables 41, 42, 43, 44, and 45) strung therebetween two tower 20 to support fire proof curtain 30. Moreover, fire proof curtain 30 may be stored above or below ground G preferably in a fire proof and weather resistant container or elongated box, such as curtain storage compartment 50. Fire proof curtain 30 may include one or more linear edges, such as top linear edge 31, bottom linear edge 33, right linear edge 32, and left linear edge 34. Furthermore, fire proof curtain 30 may be configured to resist direct flame, and contain any flying embers attempting to pass through. It is contemplated herein that various versions fire proof curtain 30 may be utilized to whether curtains with micro-holes to accommodate windy conditions while preventing or retarding the advance of the fire.

Tower 20 may be configured as hollow having an interior 23 and formed from any durable material and configured in any size or shape for upwardly displacing and supporting fire proof curtain 30. Tower 20 includes first tower 21 and second tower 22, which may be positioned a width thereapart, such as linear distance LD apart from one another. Moreover, fire proof curtain 30 and curtain storage compartment 50 are preferably configured approximately linear distance LD in length and positioned therebetween first tower 21 and second tower 22. Furthermore, tower 20 may include second tower end 26 and first tower end 27, where first tower end 27 may form a base partially submerged under or therein ground G, or first tower end 27 may be attached to a footing, such as base 28B via tower flange 28A and second tower end 26 may extend vertically a distance, such as height H above ground G. Height H may be 100 to 40 feet but other heights are contemplated herein. Tower 20 may be configured hollow, partially hollow, or configured with a channel, such as linear slot 29 running from second tower end 26 to second tower end 28. Moreover, tower 20 may be constructed of stainless aluminum, heat resistant fiberglass, plastic, steel, as these materials offers a variety of forms and shapes; however, other suitable materials such as metal, concrete, composite, and the like, formed of multiple layers with different materials, or the like, may be utilized, provided such material has sufficient strength and/or durability as would meet the purpose described herein. Furthermore, tower 20 may be tapered from bottom to top or therebetween second tower end 26 and first tower end 27.

Tower 20 includes first tower 21 and second tower 22 and the like may be placed in series across the terrain of ground G to form a fire wall or fire line, may be placed in an overlapping staggered configuration in series across the terrain of ground G to form a fire wall or fire line, and multiple fire walls or fire lines of fire containment system 10 may be placed in parallel to form two or more fire walls or fire lines of fire containment system 10.

Tower 20 may further include one or more guards, covers, or extensions, such as fire seam flap 60 affixed thereto a vertical side 25 of tower 20 positioned from approximately from second tower end 26 to second tower end 28 to provide a fire protection barrier across the gap between tower 20 and fire proof curtain 30. It is recognized herein that each vertical side 25 of tower 20 may include fire seam flap 60.

One or more support cables 40 (shown support cables 41, 42, 43, 44, and 45) fire proof cable, Kevlar (or any other fire proof type material) formed from stranded fibers to form one or more support cables 40 having a length greater than or equal to linear distance LD.

Fire proof curtain 30 may be configured as a film, ply fabric or the like planar barrier configured to produce a large surface area barrier, which may be coated with a fire-resistant insulation, such as aluminum or other fire-resistant insulation having thermo-insulating capacities and thermo-insulating gradient wherein on the exterior side of fire proof curtain 30 may withstand temperatures of at least 1200° C. and up to 2000° C. Fire proof curtain 30 may be formed of layers, sheaths, or blankets connected or attached together.

Tower 20, fire proof curtain 30, one or more support cables 40, fire proof curtain 30, and curtain storage compartment 50 may be formed of fire-resistant material either made or built of such material or are covered with such material.

Tower 20, fire proof curtain 30, one or more support cables 40, fire proof curtain 30, and curtain storage compartment 50 configured as fire containment system 10 may be placed in series arranged in end-to-end interconnected fashion across the terrain of ground G to form a continuous fire wall or fire line is created to prevent or retard the advance of the fire in a given direction. Fire containment system 10 may be placed in an overlapping staggered configuration in series across the terrain of ground G to form a fire wall or fire line, or multiple fire walls or fire lines to prevent or retard the advance of the fire in a given direction and to allow wildlife to exit the fire path. Fire containment system 10 may be placed in parallel to form two or more fire walls or fire lines to double prevent or retard the advance of the fire in a given direction. Moreover, fire containment system 10 may be suitable for fire-protection or fire-proofing of various structures and objects such as houses, buildings, industrial plants, gardens, lawns, individual trees. Furthermore, fire containment system 10 may be suitable for fire-protection or fire-proofing of timber land, recreational facilities, forests, pastures or parks and other large acreage natural resources and provide protection against fires or firestorms or may be simply used as a fire barrier to prevent fire spread.

It is recognized herein that fire containment system 10 may be configured or designed to protect against fires or firestorms or may be simply used as a fire barrier to prevent fire spread.

Figure 2A:
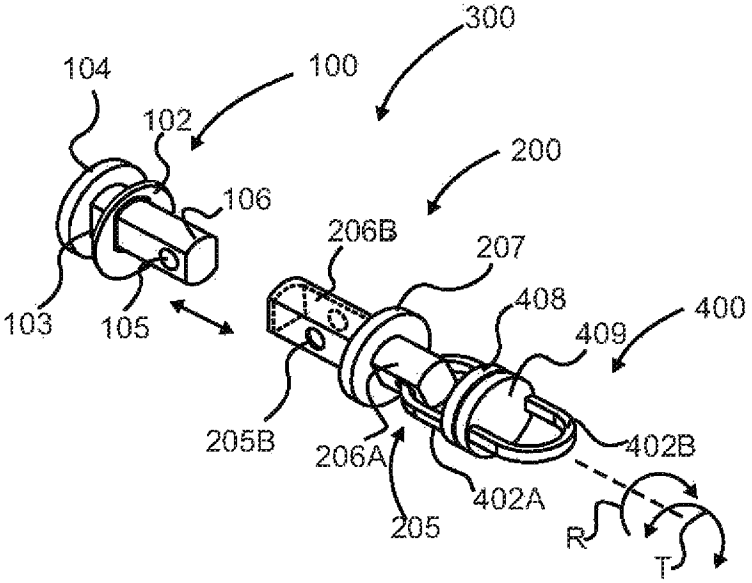
FIG. 2A is a perspective view of an exemplary embodiment of the cable lift and attachment device, according to FIG. 1.

Referring now to FIG. 2A by way of example, and not limitation, there is illustrated an example and alternate embodiment of cable lift and attachment device 300. Cable lift and attachment device 300 may include cable lift attachment device 100 and a coupler, such as curtain connector 200 for upwardly displacing and supporting one or more support cables 40 and fire proof curtain 30. Cable lift attachment device 100 may be configured to slide or traverse therein linear slot 29 of tower 20 running from second tower end 26 to first tower end 27. Moreover, cable lift attachment device 100 may include an outer guide, such as outer slider 102 and an inner guide, such as inner slider 104 with a connector or pin, such as spacer 103 positioned therebetween, where spacer 103 preferably connects outer slider 102 and inner slider 104 together or one to the other. Preferably spacer 103 may be sized and dimensioned to slide therein linear slot 29 of tower 20 while outer slider 102 and inner slider 104 may be oversized relative to linear slot 29 to prevent cable lift attachment device 100 from leaving linear slot 29. Furthermore, cable lift attachment device 100 may include a holed hanger, such as first extension hook 106 attached to or formed thereto outer slider 102 and having hole, such as first hook aperture 105. First extension hook 106 and first hook aperture 105 may be configured to affix or removeably affix one or more support cables 40 thereto cable lift attachment device 100 to raise and/or lower fire proof curtain 30 therewith one or more cable lift attachment device 100. It is contemplated herein that a variety of cable lift attachment device 100 may be utilized to raise and lower one or more support cables 40 and fire proof curtain 30 up and down tower 20, whether configured as interior or exterior positioned to tower 20. Furthermore cable lift attachment device 100 may be configured with a swivel joint 102 between spacer 103 and first extension hook 106.

Curtain connector 200 may include first end connector 206A and second end connector 206B where second end connector 206B may be configured to releasably and slidably affix thereto first loop hook 106 of outer slider 102 of cable lift attachment device 100, and a pin and clevis or bolt, quick connect, or other like known connection device may be inserted therein to secure universal curtain connector 200 to cable lift attachment device 100. First end connector 206A may include may include a holed hanger, such as second extension hook 206 attached to or formed thereto second end connector 206B with disc pinch guard 207 formed therebetween and having hole, such as second hook aperture 205. Second extension hook 206 and second hook aperture 205 may be configured to affix or curtain connector 200.

Furthermore, universal clip or universal joint clip 400 may include a universal joint, such as first rotational member 408 attached to or formed thereto first end latch connector 402A and second rotational member 409 may be attached to or formed thereto second end latch connector 402B. Preferably, first rotational member 408 and second rotational member 409 may be rotationally linked one to the other to enable rotation therebetween. First end latch connector 402A may be configured to affix or removeably affix thereto second hook aperture 205 of second extension hook 206 and second end latch connector 402B may be configured to affix or removeably affix thereto one or more support cables 40 to raise and/or lower fire proof curtain 30 therewith one or more cable lift attachment device 100. It is contemplated herein that a variety of universal clip or universal joint clip 400 may be utilized to affix or removeably affix one or more support cables 40 and fire proof curtain 30 thereto one or more cable lift attachment device 100.

Both cable lift attachment device 100, curtain connector 200, and universal clip or universal joint clip 400 may be configured to ease catch or friction between tower 20 and cable lift attachment device 100 as it's vertically raised or lowered therein linear slot 29. Thus, cable lift attachment device 100 and curtain connector 200 may provide tilt T and/or rotation R between tower 20 and one or more support cables 40 and fire proof curtain 30 to prevent catching of cable lift attachment device 100 therein linear slot 29 as cable lift attachment device 100 raises and lowers up tower 20.

Figure 2B:
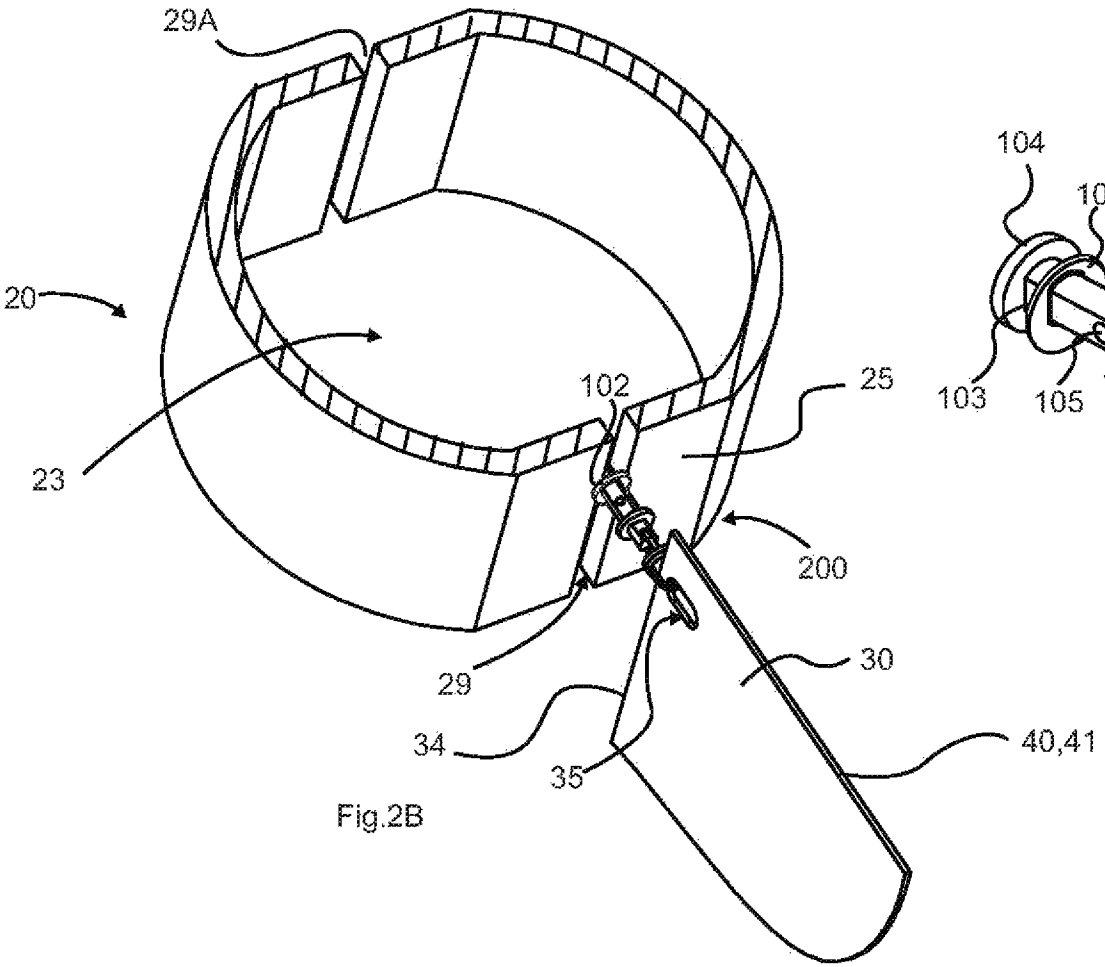
FIG. 2B is a perspective view of an exemplary embodiment of the cable lift and attachment device attached to the fire curtain, according to FIG. 2A.

Referring now to FIG. 2B by way of example, and not limitation, there is illustrated an example and alternate configuration to affix one or more support cables 40 or fire proof curtain 30 thereto cable lift attachment device 100. The other end of one or more support cables 40 may be affixed or releasably affixed to: first hook aperture 105 of first extension hook 106 of cable lift attachment device 100; second hook aperture 205 of second extension hook 206 when curtain connector 200 is preferably coupled thereto cable lift attachment device 100, or either when first end latch connector 402A of universal clip or universal joint clip 400 is preferably affixed or removeably affixed thereto curtain connector 200 which is preferably coupled thereto cable lift attachment device 100 and second end latch connector 402B is preferably affixed or removeably affixed to one or more support cables 40 or fire proof curtain 30; or when first end latch connector 402A of universal clip or universal joint clip 400 is preferably affixed or removeably affixed thereto first hook aperture 105 of first extension hook 106 of cable lift attachment device 100.

Figure 3B:
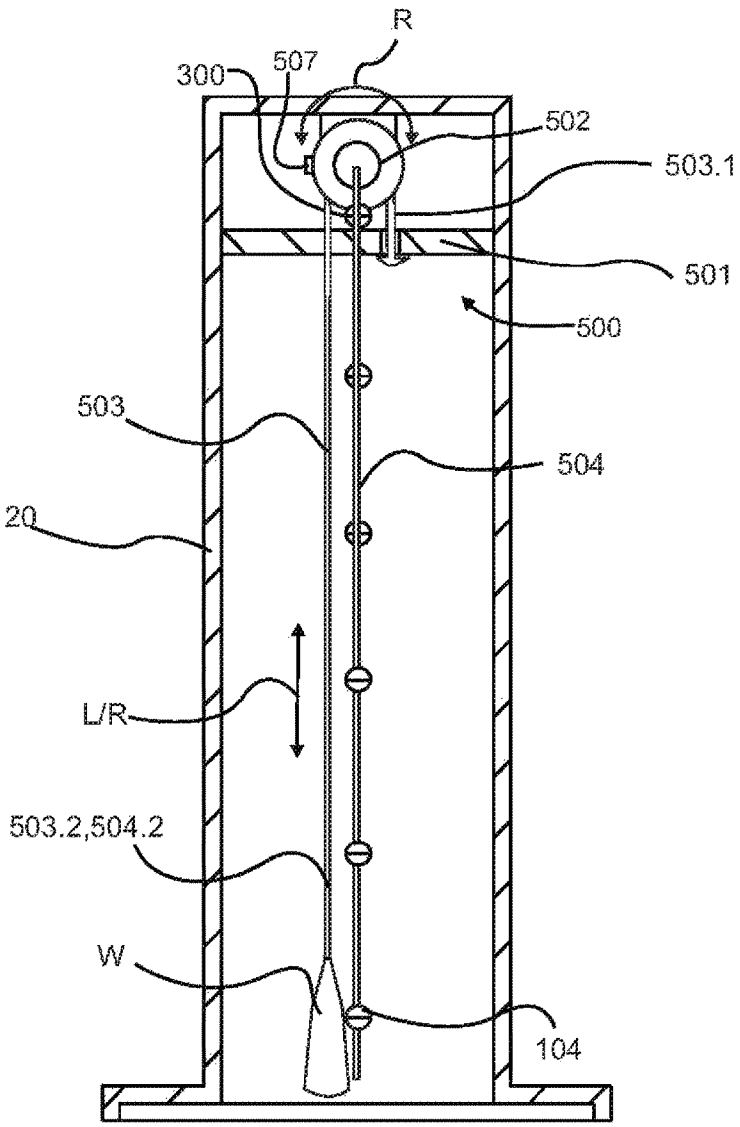
FIG. 3B is a cross sectional side view of an exemplary embodiment of tower interior exposing weight driven cable lift and attachment device, according to FIG. 3A.
Figure 3A:
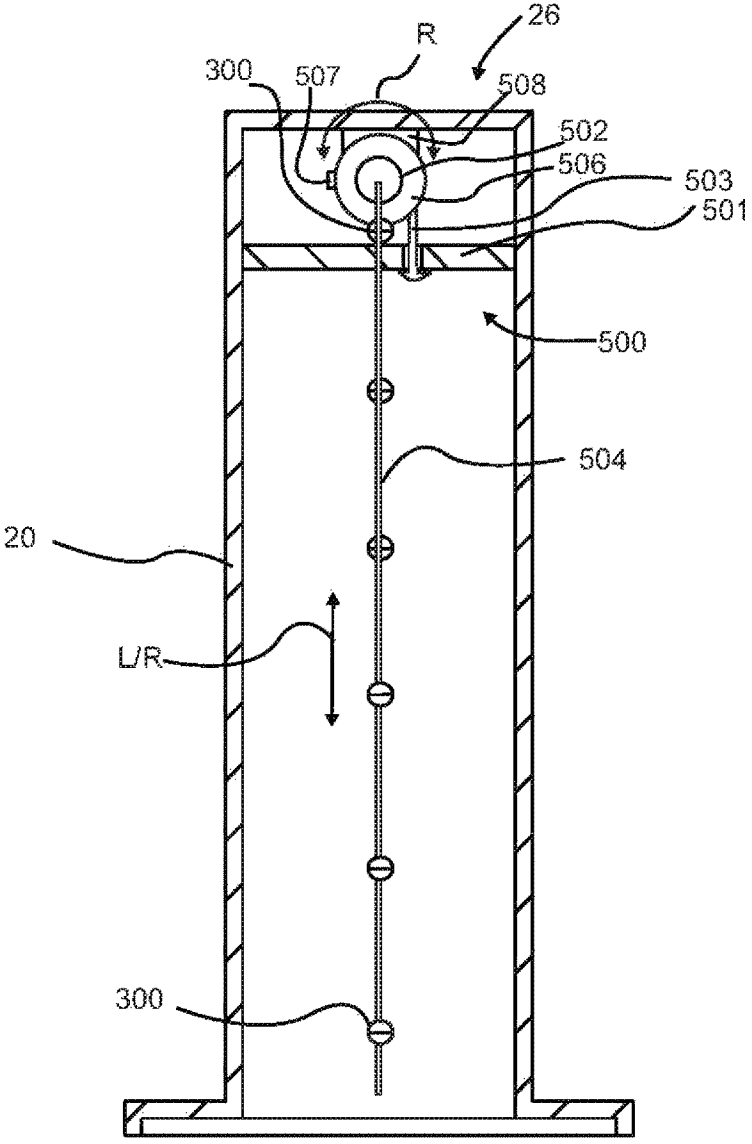
FIG. 3A is a cross sectional side view of an exemplary embodiment of tower interior exposing motorized cable lift and attachment device, according to FIG. 1.

Referring now to FIG. 3A by way of example, and not limitation, there is illustrated an example cross sectional side view of tower 20 exposing interior 23 and lift assembly 500. Lift assembly 500 may include flexible lift cable, chain, or cord, such as lift strap 504 capable of extending from curtain storage compartment 50, through first tower end 27, to second tower end 26 and beyond. One or more lift strap 504 may be affixed to lift platform 501 and lift platform 501 may be sized and configured to travel therein interior 23 of tower 20 and lift and raise L/R therein one or more lift strap 504 with one or more cable lift and attachment device 300 connected thereto and traversing therein linear slot 29. Lift assembly 500 may further include flexible lift cable, chain, or cord, such as pulley strap 503 capable of extending therearound pulley 502 and extending to and attached thereto lift platform 501. Preferably, motor 506, having motor mount 508, and rotation R thereof motor 506 coupled to pulley 502 results in raising and lowering L/R thereof pulley strap 503 and thus raising and lowering L/R thereof lift platform 501 and lift strap 504 having one or more cable lift and attachment device 300 traversing therein linear slot 29.

Alternatively, lift strap 504 may extend over and around a gear or cylinder, such as pulley 502 having pulley shaft 505 positioned therein pulley aperture 24, shown in FIG. 1, and pulley 502 may be rotationally coupled thereto motor 506, having motor mount 508, and rotation R thereof motor 506 coupled to pulley 502 results in raising and lowering L/R thereof lift strap 504 having one or more cable lift and attachment device 300 traversing therein linear slot 29.

Moreover, motor 506 may be mounted anywhere within interior 23 of tower 20. Preferably, a sensor, such as temperature, smoke, communications device, or remote wireless trigger, such as heat sensor/trigger 507 electrically connected thereto motor 506 and triggers motor 506 coupled to pulley 502 to begin rotating and rotationally lifts lift strap 504 having one or more cable lift and attachment device 300 attached thereto, which in turn raises R/L one or more support cables 40 or fire proof curtain 30 until fire proof curtain 30 is in a full up or deployed fire curtain position, as shown in FIG. 1.

Referring now to FIG. 3B by way of example, and not limitation, there is illustrated an alternate example cross sectional side view of tower 20 exposing interior 23 and alternative lift assembly 500. Preferably, weight 602 may be mechanically connected thereto by heat sensor/trigger 507 and weight 602 may be affixed thereto second strap end 503.2 and pulley strap 503 may be configured to extend therearound pulley 502 and extend to and attached thereto lift platform 501. Preferably, when weight 602 is released by heat sensor/trigger 507 rotation R thereof pulley 502 by dropping weight 602 results in raising and lowering L/R thereof pulley strap 503 and thus raising and lowering L/R thereof lift platform 501 and lift strap 504 having one or more cable lift and attachment device 300 traversing therein linear slot 29.

Alternatively, weight 602 may be affixed thereto second strap end 504.2, and when released by heat sensor/trigger 507 to support weight W and held in an elevated position. Preferably, when weight 602 is released by heat sensor/trigger 507 rotation R thereof pulley 502 by dropping weight 602 results in raising and lowering L/R thereof lift strap 504 and thus raising and lowering L/R one or more cable lift and attachment device 300 traversing therein linear slot 29.

Once temperature rises above a threshold heat sensor/trigger 507 triggers lift assembly 500 to raise lift strap 504 having one or more cable lift and attachment device 300 attached thereto, which in turn raises one or more support cables 40 or fire proof curtain 30 until fire proof curtain 30 is in a full up or deployed fire curtain position, as shown in FIG. 1.

Figure 4C:
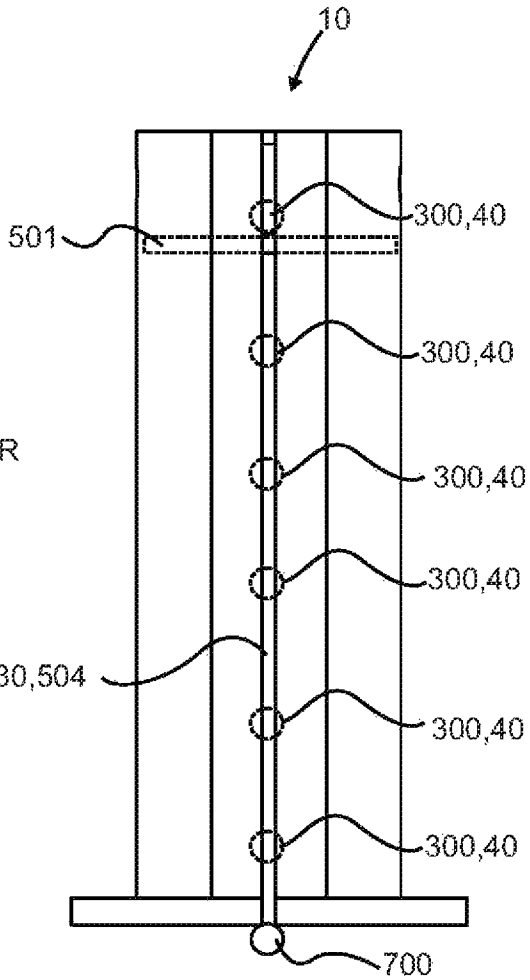
FIG. 4C is a side view of an exemplary embodiment of tower interior exposing cable lift and attachment device, with fire curtain fully deployed, as shown in FIG. 1.
Figure 4B:
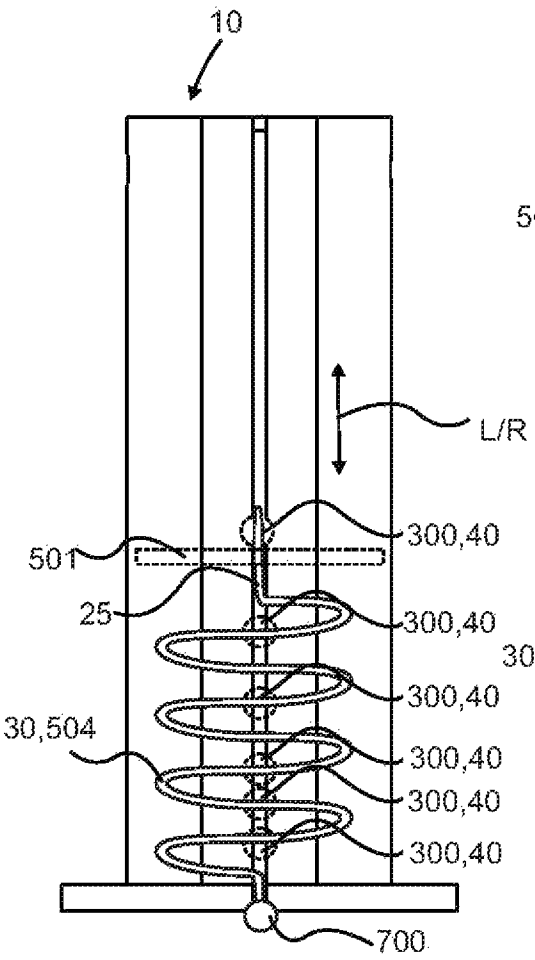
FIG. 4B is a side view of an exemplary embodiment of tower interior exposing cable lift and attachment device, with fire curtain partially deployed.
Figure 4A:
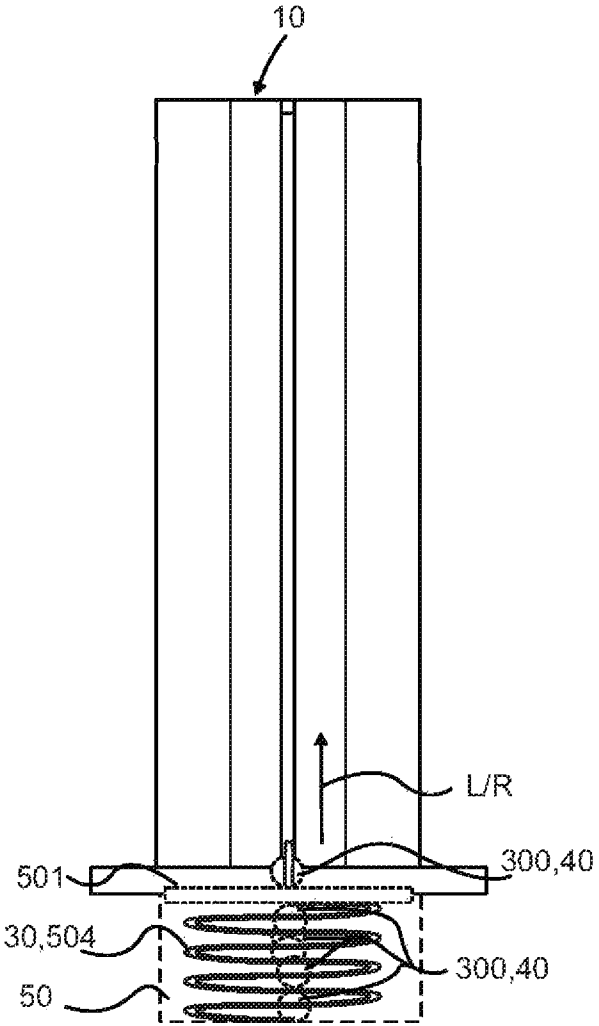
FIG. 4A is a side view of an exemplary embodiment of tower interior exposing cable lift and attachment device, with fire curtain stored in underground storage compartment.

Referring now to FIG. 4A, 4B, and 4C by way of example, and not limitation, there is illustrated a deployment of cable lift and attachment device 300. As shown in FIG. 4A, one or more cable lift and attachment device 300 attached thereto one or more support cables 40, attached thereto fire proof curtain 30 is shown pre-deployed and stored in underground storage compartment 50. As shown in FIG. 4B, 3A, and 3B, pulley 502 begins rotating and rotationally lifts lift strap 504 having one or more cable lift and attachment device 300 attached thereto, which in turn raises one or more support cables 40, and fire proof curtain 30, shown with fire proof curtain 30 partially raised. As shown in FIG. 4C, 3A, and 3B, pulley 502 continues rotating and rotationally lifts lift strap 504 having one or more cable lift and attachment device 300 attached thereto, which in turn raises one or more support cables 40, and fire proof curtain 30, until fire proof curtain 30 is in a full up position or until stopper 700 comes in contact with first tower end 27, as shown in FIG. 1.

Figure 5:
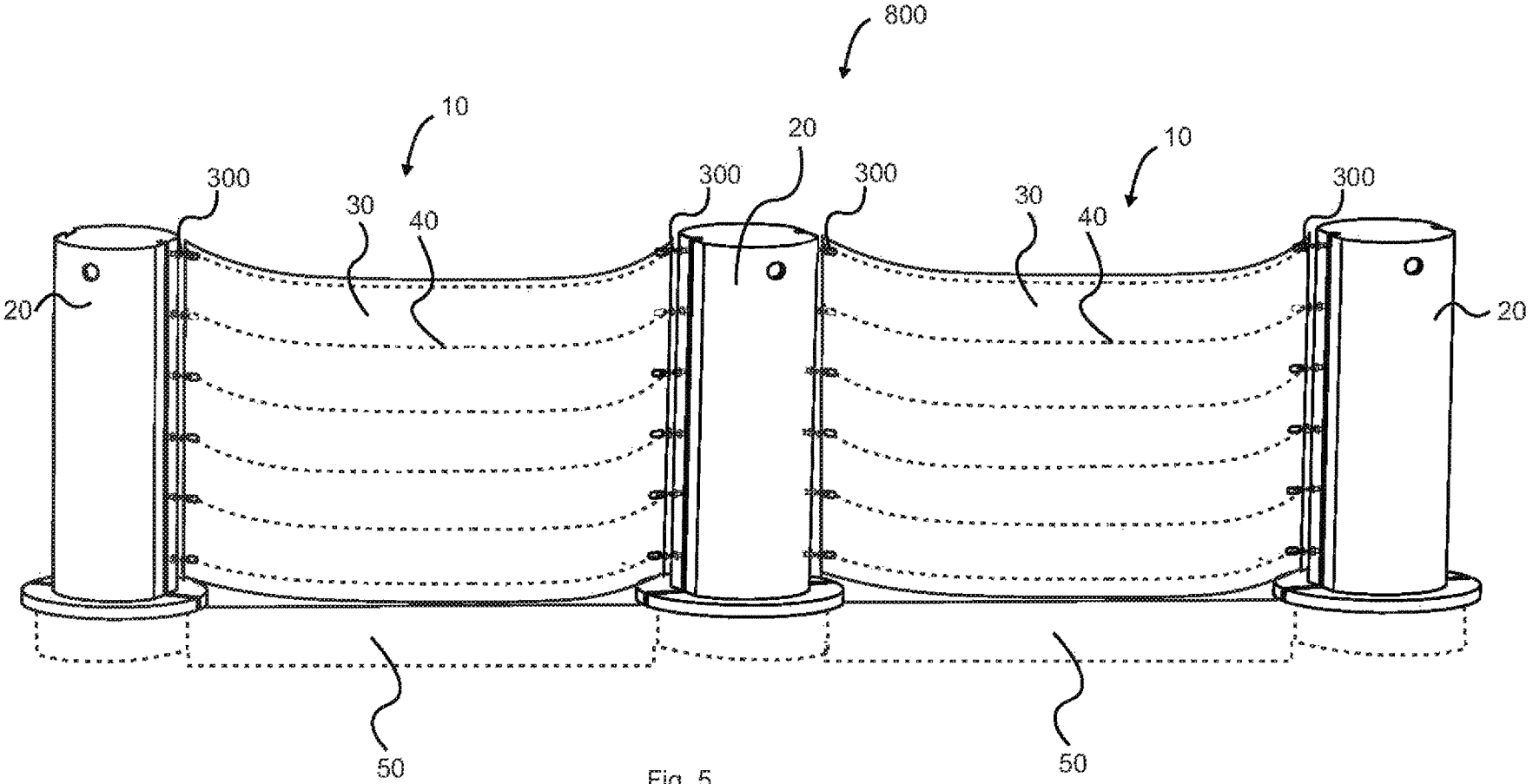
FIG. 5 is a side view of an exemplary embodiment of one or more fire containment systems as shown in FIG.1 and positioned in series.

Referring now to FIG. 5 by way of example, and not limitation, there is illustrated at least two or two or more fire containment systems 10 shown with deployed fire proof curtain 30 supported by two towers 20 positioned end-to-end, interconnected, and in series to form firewall 800. It is contemplated herein that firewall 800 may be formed of a plurality of fire containment systems 10 and run linearly any necessary distance. Moreover, at least two or two or more firewalls 800 may be utilized a first primary firewall 800 and a second firewall 800 laid out in any configuration, such as parallel to double protect, prevent, and retard the advance of the fire in a given direction.

Figure 6:
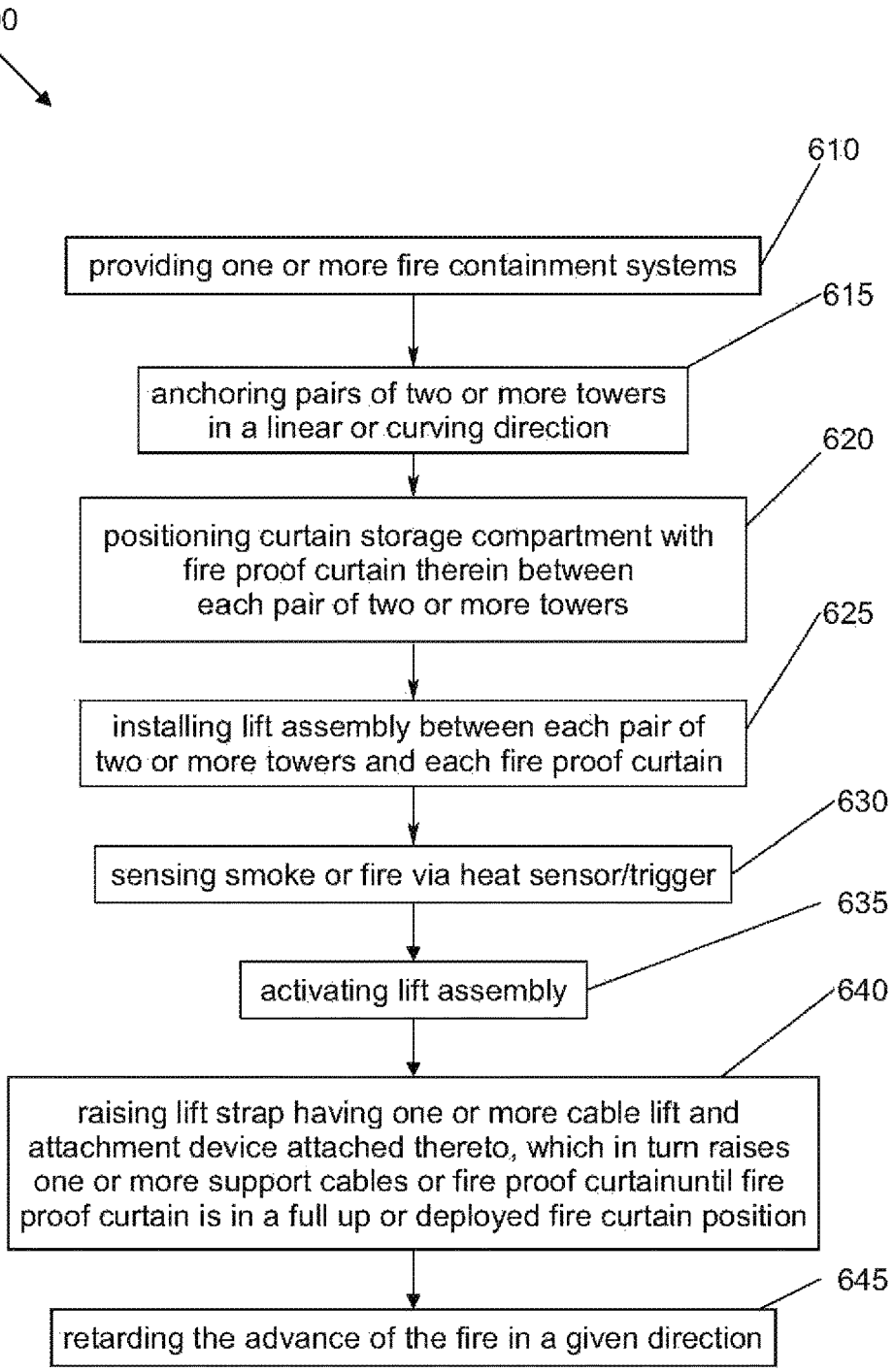
FIG. 6 is a flow diagram of a method of deploying one or more fire containment systems as shown in FIG.1 and positioned in series or parallel.

Referring now to FIG. 6, there is illustrated a flow diagram 600 of a method of use of a plurality of fire containment systems 10 to form one or more firewalls 800 as shown in FIGS. 1-5. In block or step 610, providing one or more fire containment systems 10 configured to protect, prevent, and retard the advance of the fire in a given direction. In block or step 615, anchoring pairs of two or more towers 20 in a linear or curving direction in the path of a potential fire or in a given direction where a fire may advance. In block or step 620, positioning curtain storage compartment 50 with fire proof curtain 30 therein between each pair of two or more towers 20. In block or step 625, installing lift assembly 500 between each pair of two or more towers 20 and each fire proof curtain 30.

In block or step 630, sensing smoke or fire via heat sensor/trigger 507. In block or step 635, activating lift assembly 500. In block or step 640, raising lift strap 504 having one or more cable lift and attachment device 300 attached thereto, which in turn raises one or more support cables 40 or fire proof curtain 30 until fire proof curtain 30 is in a full up or deployed fire curtain position. In block or step 645, retarding the advance of the fire in a given direction.

The foregoing description and drawings comprise illustrative embodiments of the present disclosure. Having thus described exemplary embodiments, it should be noted by those ordinarily skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments of the disclosure will come to mind to one ordinarily skilled in the art to which this disclosure pertains having the benefit of the teachings presented in the foregoing descriptions and the associated drawings. Although specific terms may be employed herein, they are used in a generic and descriptive sense only and not for purposes of limitation. Moreover, the present disclosure has been described in detail, it should be understood that various changes, substitutions and alterations can be made thereto without departing from the spirit and scope of the disclosure as defined by the appended claims. Accordingly, the present disclosure is not limited to the specific embodiments illustrated herein, but is limited only by the following claims.

What is claimed is:

1. A fire containment system to provide a fire wall barrier to a fire proceeding across a ground, said system comprising:

two or more towers anchored in series in the ground, each of said two or more towers having a slot formed therein running from a first tower end to a second tower end and an interior therein;

a lift system positioned within said interior each of said two or more towers, said lift system having a motor coupled to a pulley positioned proximate said second tower end and a pulley strap extending therearound said pulley and extending thereto a lift platform configured to traverse between said first tower end to said second tower end within said interior, a lift cable affixed to said lift platform, said lift cable having a plurality of cable attachment devices affixedly spaced thereto, each said cable attachment device having an outer slider and an inner slider with a spacer positioned therebetween, said outer slider, said inner slider, and said spacer configured to traverse therein said slot;

one or more support cables strung between said two or more towers, said one or more support cables having a first cable end and a second cable end, said first cable end affixed to one of said plurality of said cable attachment devices in a first tower of said two or more towers and said second cable end affixed to one of said plurality of said cable attachment devices in a second tower of said two or more towers; and a fire proof curtain affixed to said one or more support cables.

2. The fire containment system of claim 1, wherein each of said two or more towers is mounted on a concrete base.

3. The fire containment system of claim 1, wherein said plurality of cable attachment devices further comprises a quick connect having a first end connector affixed to said outer slider and a second end connector releasably affixed to said first end connector.

4. The fire containment system of claim 3, wherein said plurality of cable attachment devices further comprises a swivel joint, said swivel joint affixed to said second end connector, wherein said first cable end affixed to said swivel joint of one of said plurality of cable attachment devices in said first tower of said two or more towers and said second cable end affixed to said swivel joint of one of said plurality of cable lift attachment devices in said second tower of said two or more towers.

5. The fire containment system of claim 1, further comprises a curtain storage compartment positioned between said first tower and said second tower of said two or more towers.

6. The fire containment system of claim 5, wherein said curtain storage compartment configured therein the ground.

7. The fire containment system of claim 1, further comprises a fire seam flap positioned therebetween each of said two or more towers and said fire proof curtain.

8. The fire containment system of claim 1, wherein said two or more towers positioned in series in an interconnected configuration.

9. The fire containment system of claim 1, wherein said two or more towers positioned in an overlapping staggered configuration.

10. The fire containment system of claim 1, further comprises at least two rows of said two or more towers configured in parallel.

11. The fire containment system of claim 10, wherein said two rows of said two or more towers are offset.

12. The fire containment system of claim 1, wherein said outer slider configured having a first extension hook attached thereto.

13. The fire containment system of claim 12, further comprises a curtain connector configured to releasably affix said fire proof curtain thereto said first extension hook.

14. The fire containment system of claim 1, wherein said motor is electrically connected thereto a heat sensor.

15. The fire containment system of claim 14, further comprises a weight affixed to said pulley strap extending therearound said pulley and extending thereto said lift platform, wherein said weight mechanically connected thereto said heat sensor.

16. The fire containment system of claim 1, wherein said motor further comprises a remote control thereof.

* * * * *